US007065980B1

(12) United States Patent
Knight

(10) Patent No.: US 7,065,980 B1
(45) Date of Patent: Jun. 27, 2006

(54) RECHARGEABLE PORTABLE COOLING DEVICE AND METHOD

(76) Inventor: Andrew F. Knight, 2521 Glengyle Dr., Vienna, VA (US) 22181

( * ) Notice: Subject to any disclaimer, the term of this patent is extended or adjusted under 35 U.S.C. 154(b) by 18 days.

(21) Appl. No.: 10/751,509

(22) Filed: Jan. 6, 2004

(51) Int. Cl.
*F17C 13/00* (2006.01)

(52) U.S. Cl. ..... 62/457.9

(58) Field of Classification Search .... 62/457.1–457.9, 62/480; 66/457.1–457.9, 480
See application file for complete search history.

(56) References Cited

U.S. PATENT DOCUMENTS

| | | | | |
|---|---|---|---|---|
| 1,897,723 | A | 2/1933 | Free | |
| 3,987,643 | A | 10/1976 | Willis | |
| 4,126,016 | A * | 11/1978 | Greiner | 62/457.9 |
| 4,340,076 | A * | 7/1982 | Weitzen | 137/13 |
| 4,766,732 | A * | 8/1988 | Rubin | 62/62 |
| 4,976,112 | A * | 12/1990 | Roberts et al. | 62/48.1 |
| 5,154,067 | A * | 10/1992 | Tomizawa et al. | 62/480 |
| 5,201,183 | A | 4/1993 | Ramos | |
| 5,325,680 | A | 7/1994 | Baroso-Lujan et al. | |
| 5,865,036 | A * | 2/1999 | Anthony | 62/293 |
| 6,029,457 | A * | 2/2000 | Neeser et al. | 62/46.1 |
| 6,173,579 | B1 | 1/2001 | Davidson | |
| 6,349,560 | B1 * | 2/2002 | Maier-Laxhuber et al. | 62/457.9 |
| 6,378,326 | B1 * | 4/2002 | Maier-Laxhuber et al. | 62/480 |
| 2005/0061006 | A1 * | 3/2005 | Bonaquist et al. | |

* cited by examiner

*Primary Examiner*—Mohammad M. Ali

(57) ABSTRACT

A rechargeable cooling device includes: a first reservoir configured to contain a liquid; a second reservoir configured to contain a vapor of the liquid; a heat exchanger connected to the first or second reservoir; and a reusable valve, where the cooling device is configured so that: (a) when the first reservoir contains the liquid at a first pressure and the second reservoir contains the vapor at a lower pressure, the heat exchanger may be made to absorb heat at least in part by opening the reusable valve and allowing the liquid to vaporize; and (b) when pressures in the first and second reservoirs are approximately equal, and after the heat exchanger has been made to absorb heat, the cooling device may be recharged for a subsequent use at least in part by cooling the cooling device.

19 Claims, 3 Drawing Sheets

RECHARGEABLE PORTABLE COOLING DEVICE AND METHOD

BACKGROUND OF THE INVENTION

Portable cooling devices for cooling foods or beverages, such as self-contained beverage cans that cool their contents at the press of a button, are well known in the art. Typically, the beverage can will contain either: a) two chemicals separated by a breakable membrane that are endothermically reactive; or b) a container of a high pressure liquid or gas expandable through a breakable valve such that vaporization or Joule-Thomson expansion, or both, causes a refrigeration effect.

One problem with the present refrigerant-based designs is that the refrigerant is exhausted into the atmosphere. Therefore, the refrigerant should be nontoxic, chemically stable, and environmentally friendly. A refrigerant that meets these requirements is carbon dioxide; however, liquid carbon dioxide has an excessively high vapor pressure at room temperature, which requires a heavier container and causes more consumer risk.

Another problem with both present designs (chemical reactants and refrigerants) is that they are not reusable. Once the chemicals have endothermically reacted, or once the refrigerant has expanded, the process cannot be repeated.

SUMMARY OF THE INVENTION

The present invention aims to solve at least one of these and other problems.

According to a preferred embodiment of the present invention, a rechargeable cooling device may comprise: a first reservoir configured to contain a liquid; a second reservoir configured to contain a vapor of the liquid; a heat exchanger connected to at least one of the first and second reservoirs; and a reusable valve, wherein the first reservoir is in fluid connection with the second reservoir via the reusable valve, and wherein the cooling device is configured so that: (a) when the first reservoir contains the liquid at a first pressure and the second reservoir contains the vapor at a second pressure lower than the first pressure, the heat exchanger may be made to absorb heat at least in part by opening the reusable valve and allowing the liquid to vaporize as the first and second pressures equalize; and (b) when pressures in the first and second reservoirs are approximately equal at a first temperature, and after the heat exchanger has been made to absorb heat, the cooling device may be recharged for a subsequent use at least in part by cooling the cooling device to a second temperature lower than the first temperature and, optionally, subsequently closing the reusable valve. The second reservoir may have a volume at least ten times greater than a volume of the first reservoir. Further, the second reservoir may further comprise an absorbent material chosen to absorb the vapor.

The device may further comprise the liquid, wherein the liquid is a refrigerant having a vapor pressure at room temperature greater than 1 atm. The refrigerant may be carbon dioxide or a hydrocarbon, such as butane or propane. The device may comprise the liquid in a quantity such that, when the valve is open and pressures in the first and second reservoirs are approximately equal at the first temperature, the liquid is substantially entirely vaporized, wherein the first temperature is in the range of approximately 70° to 100° F.

The device may further comprise a third reservoir connected to the heat exchanger and configured to hold a substance desired to be cooled. Further, the rechargeable cooling device may be an insulated mug, and wherein the third reservoir is shaped to contain no more than about 16 fluid ounces of a beverage. Alternatively, the rechargeable cooling device may be an insulated cooler having a storage volume in excess of one cubic foot, and wherein the third reservoir is the storage volume. Alternatively, the rechargeable cooling device may be an insulated cooler having a storage volume in excess of one cubic foot, and wherein the third reservoir is a cooling volume of the storage volume having a volume not more than about 48 fluid ounces. The cooling volume may be shaped to hold and cool at least one and not more than four 12-ounce beverage cans.

The second reservoir may comprise a funnel configured so that while the cooling device is being cooled to the second temperature, liquid condensed from the vapor in the second reservoir falls down the funnel into the first reservoir. The valve may comprise a valving portion configured to mate with a bottom of the funnel, and wherein the valve may be opened by moving the valving portion downward and closed by moving the valving portion upward. Alternatively, the valve may comprise a valving portion configured to mate with a bottom of the funnel, and wherein the valve may be opened by moving the valving portion upward and closed by moving the valving portion downward. The valve may be pressure regulating so as to prevent the first pressure from exceeding a predetermined maximum pressure.

The device may further comprise a refrigerator, such as a closed-loop refrigerant-based system, comprising a second heat exchanger connected to at least one of the first and second reservoirs, the refrigerator configured to cool and condense the vapor during recharging of the cooling device. The refrigerator may be removably connected to the cooling device.

The valve may be adjustable so that a flow rate of vapor passing through the valve may be adjusted. The device may further comprise a pressure relief valve connected to at least one of the first and second reservoirs.

According to another preferred embodiment of the present invention, a method for cooling a substance may comprise: providing a rechargeable cooling device, comprising: a first reservoir configured to contain a liquid; a econd reservoir configured to contain a vapor of the liquid; a heat exchanger connected to at least one of the first and second reservoirs; and a reusable valve, wherein the first reservoir is in fluid connection with the second reservoir via the reusable valve; placing the substance in thermal contact with the heat exchanger; opening the reusable valve when the first reservoir contains the liquid at a first pressure and the second reservoir contains the vapor at a second pressure lower than the first pressure; allowing the liquid to vaporize and the heat exchanger to absorb heat from the substance; and recharging the cooling device by: cooling the vapor to condense the vapor into the liquid; containing substantially all of the condensed liquid in the first reservoir by, if necessary, transferring the condensed liquid to the first reservoir; and closing the reusable valve. The second reservoir may have a volume at least ten times greater than a volume of the first reservoir. The second reservoir may further comprise an absorbent material chosen to absorb the vapor.

The method may further comprise providing the liquid, wherein the liquid is a refrigerant having a vapor pressure at room temperature greater than 1 atm. The method may further comprise providing the liquid in a quantity such that, when the valve is open and pressures in the first and second reservoirs are approximately equal at a first temperature, the liquid is substantially entirely vaporized, wherein the first temperature is in the range of approximately 70° to 100° F.

The method may further comprise providing a third reservoir connected to the heat exchanger, and placing the substance in the third reservoir. The rechargeable cooling device may be an insulated mug, and wherein the third reservoir is shaped to contain no more than about 16 fluid ounces of a beverage. Alternatively, the rechargeable cooling device may be an insulated cooler having a storage volume in excess of one cubic foot, and wherein the third reservoir is the storage volume. Alternatively, the rechargeable cooling device may be an insulated cooler having a storage volume in excess of one cubic foot, and wherein the third reservoir is a cooling volume of the storage volume having a volume not more than about 48 fluid ounces. The cooling volume may be shaped to hold and cool at least one and not more than four 12-ounce beverage cans.

The second reservoir may comprise a funnel configured so that during the step of cooling the vapor, liquid condensed from the vapor in the second reservoir falls down the funnel into the first reservoir. The valve may comprise a valving portion configured to mate with a bottom of the funnel, and wherein the valve may be opened by moving the valving portion downward and closed by moving the valving portion upward. Alternatively, the valve may comprise a valving portion configured to mate with a bottom of the funnel, and wherein the valve may be opened by moving the valving portion upward and closed by moving the valving portion downward. The valve may be pressure regulating so as to prevent the first pressure from exceeding a predetermined maximum pressure.

The method may further comprise providing a refrigerator, such as a closed-loop refrigerant-based system, comprising a second heat exchanger connected to at least one of the first and second reservoirs, the refrigerator configured to cool and condense the vapor during the recharging of the cooling device. The may be removably connected to the cooling device.

The valve may be adjustable so that a flow rate of vapor passing through the valve may be adjusted. The method may further comprise providing a pressure relief valve connected to at least one of the first and second reservoirs.

According to another preferred embodiment of the present invention, a method of advertising a rechargeable cooling device may comprise: indicating that the cooling device is capable of cooling at least one of foods and beverages without an external source of power; and indicating that the cooling device may be recharged for a subsequent use at least in part by cooling the cooling device in a freezer; and indicating that the cooling device is capable of the cooling at any time, on demand, after the cooling device has been recharged and removed from the freezer. The method may further comprise indicating that the cooling device has any, some, or all of the characteristics or features described herein.

DETAILED DESCRIPTION OF PREFERRED EMBODIMENTS

The disclosures of U.S. Pat. Nos. 1,897,723, 5,201,183, 5,325,680, and 6,173,579 are hereby incorporated by reference to the extent necessary to enable one of ordinary skill in the art to practice the present invention.

Figure 1:
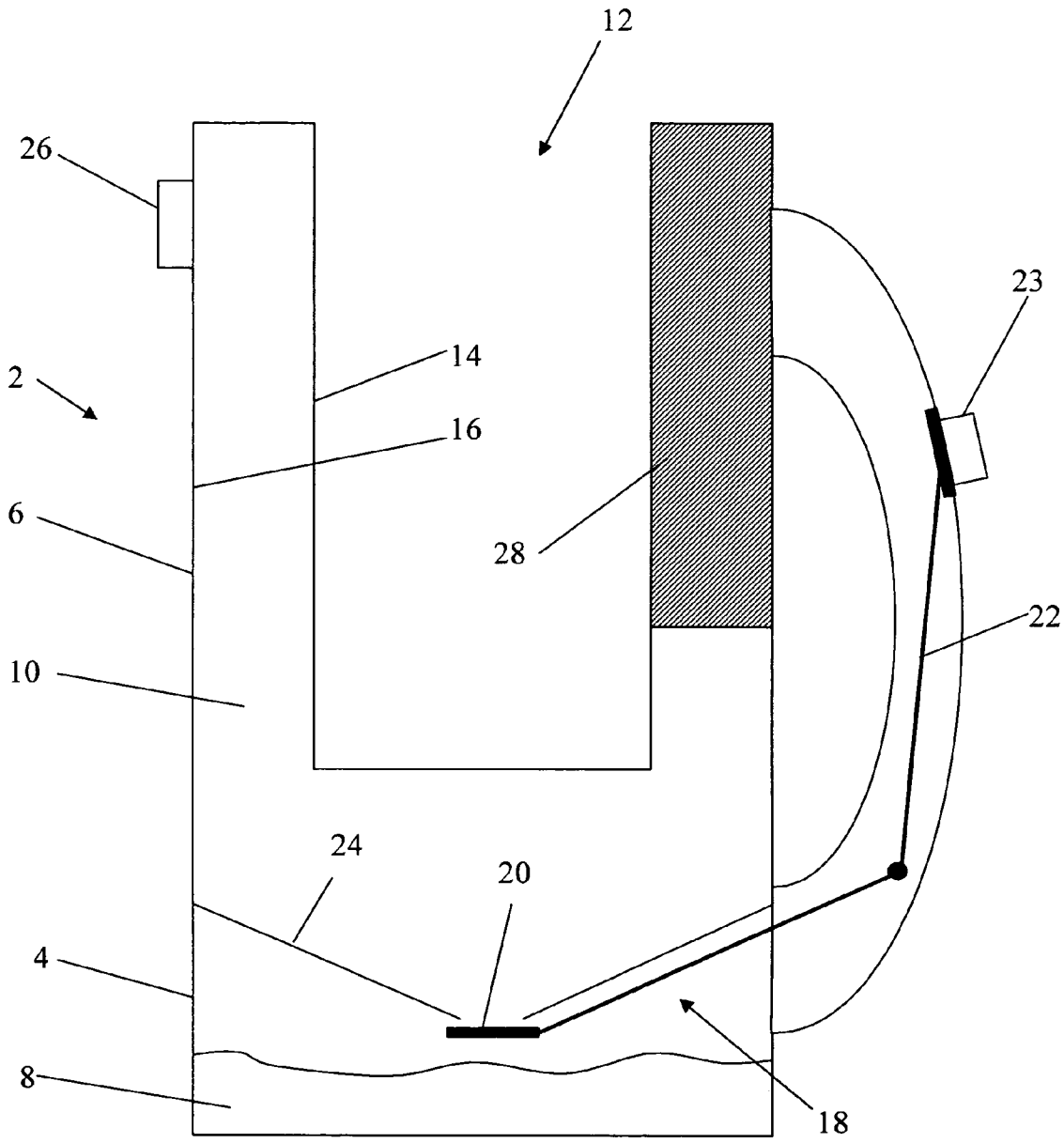
FIG. 1 shows a cross sectional side view of a rechargeable cooling mug according to a preferred embodiment of the present invention.

Referring now to FIG. 1, a rechargeable cooling mug 2 comprises a first reservoir 4 containing a liquid 8 having a high vapor pressure; a second reservoir 6 containing a vapor 10 of the liquid 8; a third reservoir 12 configured to hold a substance desired to be cooled; a heat exchanger surface 14; an outside insulating surface 16; a valve 18 comprising a valving portion 20, linkages 22, and button 23; a funnel 24 configured to direct condensed vapor 10 into first reservoir 4; a pressure relief valve 26; and an absorbent material 28.

The liquid 8 is preferably a refrigerant, and more particularly a refrigerant having a vapor pressure at room temperature in excess of 1 atm. The refrigerant may have a vapor pressure at room temperature in excess of 2 atm, 5 atm, 10 atm, 20 atm, or 50 atm. Refrigerants are well known in the art. Examples may include a hydrocarbon (such as ethane, butane, or propane, etc.), an inorganic (such as carbon dioxide, nitrous oxide, ammonia, etc.), or one of the many typical consumer refrigerants (such as R-12 or R-134). Butane is particularly useful because it has a vapor pressure of about 1 atm at the freezing point of water (32° F.). These are merely examples; any refrigerant may suffice. The quantity of liquid 8 may be chosen so that, when the valve 18 is open and pressures of vapor 10 in the first and second reservoirs 4, 6 are about equal at a desired usage temperature, the liquid 8 is substantially entirely vaporized. The desired usage temperature may correspond to any temperature in which the mug 2 is likely to be used, and may be between 50° F. and 120° F., preferably between 70° F. and 100° F., and more preferably between 80° F. and 90° F.

The second reservoir 6 is configured for the expansion of vapor 10 of liquid 8 as liquid 8 boils. Because the volume (Vg) filled by a particular mass of gas is substantially greater than the volume (V1) filled by the same mass of the liquid form of the gas, the second reservoir 6 should also be approximately correspondingly larger in volume than the first reservoir 4. For example, propane has a vapor pressure at 80° F. of about 128 psi. Letting $m=\rho(V1)=P(Vg)M/RuT$, where $\rho$ is the liquid density, P is pressure, M is molecular mass, Ru is the universal gas constant, and T is absolute temperature, $Vg/V1=RT\rho/MP$. For propane at 80° F., Vg/V1 is about 38. For liquid carbon dioxide, Vg/V1 is about 8, and for butane it is about 100. Thus, in a preferred embodiment, second reservoir 6 has a volume at least approximately 4 times, possibly more than approximately 7 times, possibly more than approximately 10 times, possibly more than approximately 20 times, possibly more than approximately 40 times the volume of the first reservoir 4.

The third reservoir 12 is configured to contain a substance to be cooled, such as food or beverage. Preferably the third reservoir 12 is cup-shaped and shaped to contain less than 40 fluid ounces of a beverage, preferably less than 24 fluid ounces, preferably less than 16 fluid ounces, and preferably less than 12 fluid ounces. Further, the third reservoir 12 is preferably shaped to hold and accommodate a typical 12-ounce beverage can. The cooling mug 2 includes a heat exchanging surface 14 in the region of the third reservoir 12. The heat exchanger 14 may comprise a thermally conducting material, such as a metal such as copper or aluminum. The heat exchanger 14 may include a smooth surface or a rugged, compressible surface, such as a thermally conductive metal sponge or metal prongs, such that the heat exchanger 14 makes good contact with a beverage can placed therein. Other ways of transferring heat from heat exchanger 14 to the substance desired to be cooled in third reservoir 12 will be understood by those of ordinary skill in the art.

The cooling mug 2 may also include a thermally insulating outer surface 16 to prevent or retard cool vapor 10 inside the second reservoir 6 from absorbing heat other than from contents of the third reservoir 12. Insulation materials are well known in the art.

The second reservoir 6 may include a funnel 24, preferably separating the second reservoir 6 from the first reservoir 4, configured to funnel or direct condensed vapor 10 (which is condensed to liquid 8) from second reservoir 6 to first reservoir 4.

The first and second reservoirs 4, 6 may be in fluid connection via a valve 18. When the button 23 is pressed, force is transmitted through linkages 22 to valve plate or valving portion 20, which is in sealed connected to a bottom of the funnel 24. The valve plate 20 then lowers away from the bottom of the funnel 24, causing the valve 18 to open, and allows vapor 10 of liquid 8 to flow upward from the first reservoir 4 to the second reservoir 6. Because the valve plate 20 is located on the same side of funnel 24 as first reservoir 4, the valve 18 is held closed by a differential pressure force when the pressure of vapor 10 in the first reservoir 4 is greater than the pressure of vapor 10 in the second reservoir 6. Further, valve plate 20 may include a sealing surface, such as a rubber or plastic gasket, to prevent passage of gas from first reservoir 4 to second reservoir 6 when valve 18 is closed.

Further, cooling mug 2 may include a pressure relief valve 26 connected to one or both of the first and second reservoirs 4, 6, and configured to release pressure when the pressure exceeds a predetermined maximum pressure. Preferably the predetermined maximum pressure is approximately equal to or lower than or substantially lower than a maximum expected operating pressure (MEOP) of the reservoir 4, 6 to which the pressure relief valve 26 is attached. Pressure relief valve may be a reusable type, such as one incorporating a spring (such as an adjustable spring), or a one-use type, such as one using a thin, breakable membrane. Further, cooling mug 2 may include an absorbent material chosen to absorb vapor 10. Such a material allows the volume of the second reservoir 6 to be smaller than otherwise allowable, because the density of the refrigerant comprising liquid 8 and vapor 10 is greater than the density of vapor 10 when absorbed in absorbent material 28. Such absorbent materials depend on the choice of the refrigerant and are well known by those of ordinary skill in the art.

Operation of the cooling mug 2 will now be described with respect to a full use cycle. First, the mug 2 begins in a ready-to-use state. In this state, the first reservoir 4 is full or mostly full of liquid 8, and some vapor 10 of liquid 8 exists in both the first and second reservoirs 4, 6. In this state, the mug 2 has been brought to approximately room temperature (or the temperature of a preferred working environment, such as at the beach), and the pressure of vapor 10 in the first reservoir 4 is substantially greater than the pressure of vapor 10 in the second reservoir 6. In the next state, a consumer desires to use the cooling mug 2 to cool a beverage. The consumer places a beverage (such as a 12-ounce beverage can) into the third reservoir 12, and presses the button 23, causing valve plate 20 to drop away from the bottom of funnel 24 and the valve 18 to open. Because of the pressure differential between first and second reservoirs 4, 6, vapor 10 flows from first reservoir 4 to second reservoir 6. To compensate for this vapor loss in first reservoir 4, liquid 8 begins to boil or vaporize, thus causing a refrigeration effect as cooler vapor 10 flows into second reservoir 6. The cool vapor 10 contacts heat exchanging surface 14 and absorbs heat from the beverage can in third reservoir 12. The process continues until the valve 18 is closed, the liquid 8 has completely vaporized, or the cooling mug 2 has reached ambient temperature. As discussed, if absorbent material 28 is included, it will absorb some of vapor 10. Further, as discussed, if the pressure inside the first or second reservoirs 4, 6 exceeds a predetermined maximum pressure, pressure relief valve 26 will relieve the pressure.

In the next state, after the consumer has used the cooling mug 2 to cool a beverage in the third reservoir 12, the consumer may recharge the cooling mug 2. This may be accomplished by placing the mug 2 in a freezer, such as a conventional freezer attached to a home refrigerator, and allowing the temperature of vapor 10 in the first and second reservoirs 4, 6 to drop. As the temperature drops, vapor 10 will condense back into liquid 8. Liquid 8 already in the first reservoir 4 will simply drop to the bottom of first reservoir 4. Liquid 8 condensed in the second reservoir 6 will fall toward funnel 24 and be directed by the slope of funnel 24 into the first reservoir 4. Of course, in the embodiment shown, the valve 18 should be open during this recharging process to allow liquid 8 to flow from the second reservoir 6 to the first reservoir 4. This may be accomplished by a "touch-and-hold" button 23 that opens the valve 18 upon pressing once, and closes the valve 18 upon pressing a second time. In other words, the button 23 may be configured to hold valve 18 open while the mug 2 is in the freezer until the consumer again closes the valve 18. The recharging process is completed when all of vapor 10 in the first and second reservoirs 4, 6 has reached the desired cooled temperature (such as about 30° F., as in a conventional freezer), and preferably most of the refrigerant mass is located in the first reservoir 4 in the form of liquid 8. Finally, the cooling mug 2 may be removed from the freezer and allowed to heat to ambient or room temperature. Then, the cooling mug 2 is recharged and ready to be reused.

Figure 2:
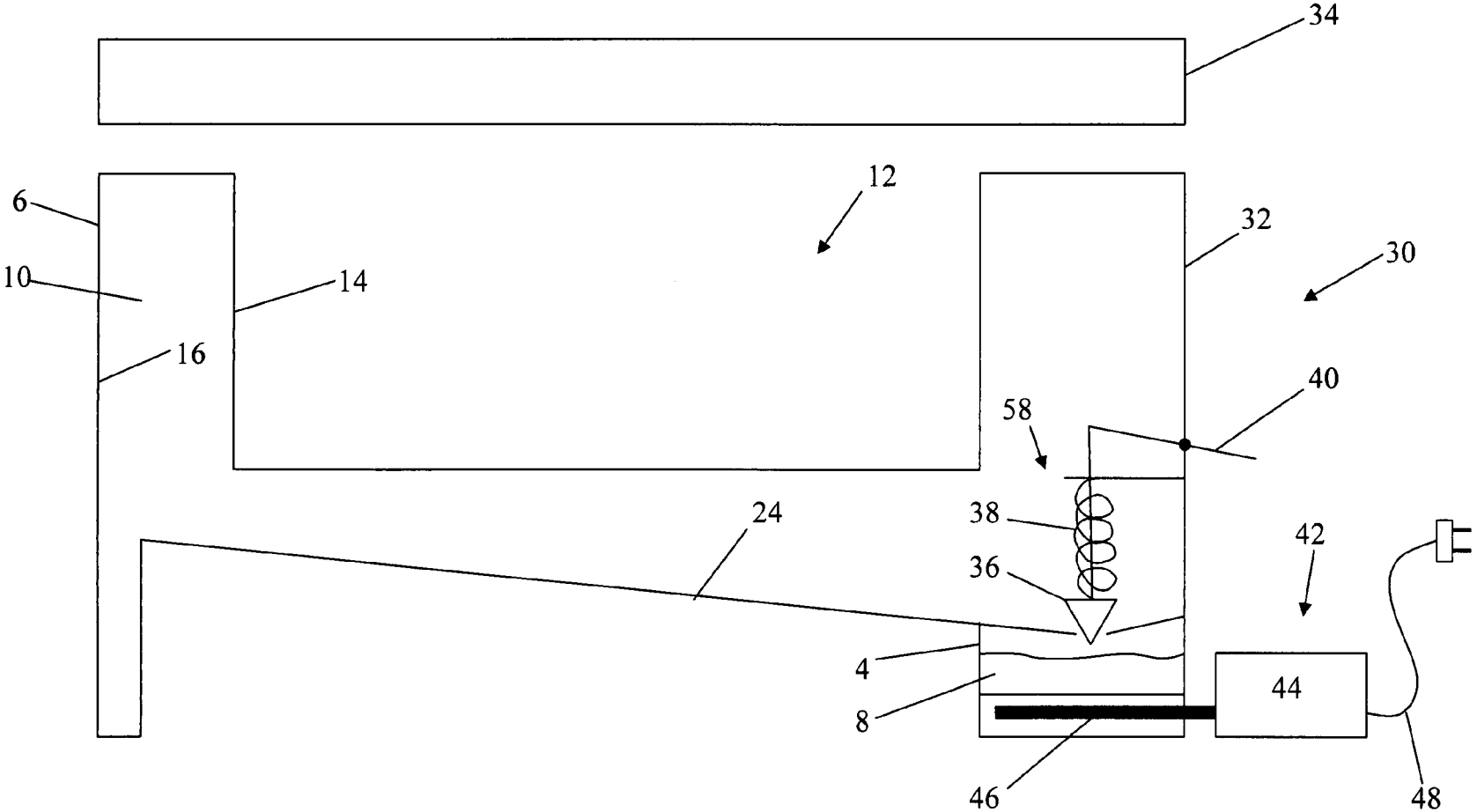
FIG. 2 shows a cross sectional side view of a rechargeable cooler according to a preferred embodiment of the present invention.
Figure 3:
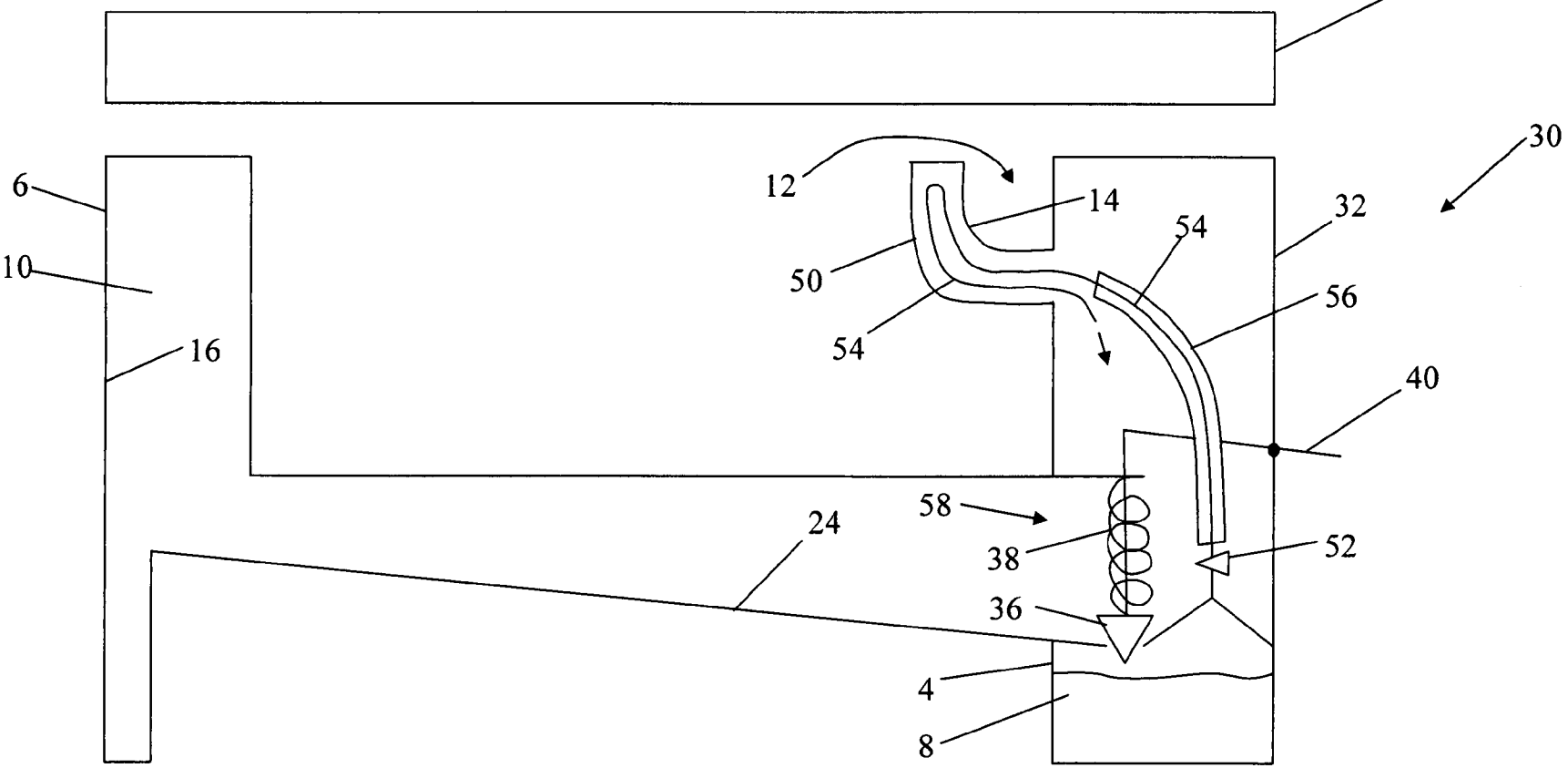
FIG. 3 shows a cross sectional side view of a rechargeable cooler according to another preferred embodiment of the present invention.

Referring now to FIG. 2, a rechargeable cooler 30 according to an embodiment of the present invention. Reference numbers common in FIGS. 1–3 represent similar or corresponding elements. For example, cooler 30 includes first and second reservoirs 4, 6, first reservoir 4 containing a refrigerant liquid 8 and the second reservoir 6 containing vapor 10 of the liquid 8. Cooler 30 differs from the cooling mug 2 in FIG. 1 in several ways.

First, cooler 30 is a large cooler having an insulating lid 34, a base portion 32, and a storage volume preferably in excess of 0.5 cubic feet, preferably greater than 1 cubic foot, preferably greater than 2 cubic feet, and preferably greater than 4 cubic feet. In the embodiment shown in FIG. 2, the entire storage volume corresponds to the third reservoir 12.

Second, cooler 30 includes a valve 58 comprising a valving portion 36, a spring 38, and a linkage and lever portion 40. Valve 58 differs from valve 18 in FIG. 1 in that the valving portion 36 is located on a side of the funnel 24 opposite to the first reservoir 4, so that valve 58 opens when valving portion 36 is lifted in a direction away from the first reservoir 4. Valving portion 36 may, e.g., be in the form of a rubber or plastic conical plug, as shown. Because the pressure of vapor 10 in first reservoir 4 is, in the typical ready-to-use state, much greater than the pressure of vapor 10 in second reservoir 6, the differential pressure causes an lifting force on the valving portion 36 to open valve 58. To prevent this, the valving portion 36 is downward biased by a spring 38 or its equivalent (such as a pressure-filled or hydraulic device). The tension of the spring 38 may or may not be adjustable, and is preferably configured to pressure regulate the pressure inside first reservoir 4 to less than or equal to a maximum pressure. When the cooler 30 is in the ready-to-use state, the cooling capability of the cooler 30 may be activated by pressing on linkage/lever 40 to lift valving portion 36 and to open valve 58, allowing high-pressure vapor 10 in first reservoir 4 to expand into second reservoir 6.

Third, because cooler 30 may be too large to fit in a conventional freezer, the cooler 30 may also include an optionally removable refrigerator 42. Refrigerator 42 may include a heat exchanger 46 that may be placed in thermal contact with the first reservoir 4. Also, refrigerator 42 may be of any type currently known, such as a thermionic, thermoelectric, or refrigerant-based type, and may include a main unit 44. For a refrigerant-based type, the main unit 44 may include a compressor, a Joule-Thomson valve, a condenser, and another heat exchanger. The refrigerator 42 may be externally powered, e.g., through a conventional plug 48 for conventional power outlets.

The operation of the cooler 30 is similar to the operation of cooling mug 2. One primary difference is that, in one embodiment, instead of placing the cooler 30 in a freezer during recharging, the refrigerator 42 may be connected to the cooler 30 so that heat exchanger 46 is in thermal contact with the first reservoir 4. Then, while valve 58 is open, the refrigerator 42 is operated, and vapor 10 condenses in the first reservoir 4 as heat is absorbed by heat exchanger 46. As vapor 10 condenses, more vapor 10 from the second reservoir 6 will flow into the first reservoir 4, where it will continue to condense. Further, because little if any condensation occurs in the second reservoir in the embodiment utilizing a refrigerator 42 thermally connected to first reservoir 4, the present embodiment may not require funnel 24.

Referring now to FIG. 3, in another preferred embodiment of the present invention, cooler 30 includes a cooling volume 50 that is substantially smaller than the total storage volume of cooler 30. Specifically, cooling volume 50 has a volume preferably no more than about 48 fluid ounces, and is shaped to hold between one and four beverages, such as 12-ounce beverage cans. In this embodiment, the cooling volume 50 corresponds substantially to the third reservoir 12, such that the heat exchanging surface 14 is located on the inside of the cooling volume 50. Further, in order to preferentially direct the cooling power of vaporizing liquid 8 to the cooling volume 50 (as opposed to the whole of second reservoir 6), the cooler 30 also includes a heat conducting conduit 54 connected to first reservoir 4 via a second valve 52. The conduit 54 is preferably shrouded in an insulator 56 until the conduit 54 reaches the cooling volume 50, as shown.

Operation is similar to the embodiments discussed, except for the following. When the cooler 30 is in a ready-to-use state, valve 52 is opened. Of course, valve 52 (as with valves 18 and 58) may be of any type, such as mechanical or electrically actuated. When valve 52 is opened, cool vapor 10 preferentially flows through the insulated region of conduit 54 to the cooling volume 50 portion of conduit 54, where conduit 54 is no longer insulated and where conduit 54 is thermally connected to heat exchanger 14, and heat may be absorbed by cool vapor 10 via heat exchanger 14. Finally, the warmed vapor 10 exits conduit 54 as shown by the arrow, and freely enters the second reservoir 6. When the consumer desires to recharge the cooler 30, valve 52 is closed and valve 58 is opened and the vapor 10 is cooled, as discussed previously. In one embodiment, valve 58 may be eliminated (such as where a refrigerator 42 is thermally connected to the first reservoir 4).

Of course, the various aspects of the embodiments shown in FIGS. 1–3 may be mixed and matched as desired, where possible. Further, the present invention is not limited to only those embodiments shown. For example, there may be other ways to transfer condensed liquid 8 to the first reservoir 4 during the recharging process other than by using a funnel 24. For example, the mug 2 or cooler 30 may include a hand-operated or motor-driven mechanical pump to pump condensed liquid 8 to the first reservoir 4. In such an embodiment, it is not required that the second reservoir 6 be above the first reservoir 4. Further, the valve 18 may be spring loaded so that the valve plate 20 is very slightly biased upward against the bottom of the funnel 24. Other variations are within the scope of the present invention.

In another embodiment, the present invention provides for a method of advertising a rechargeable cooling device, comprising the steps of indicating that the cooling device 2, 30 has any, some, or all of the features or characteristics herein disclosed.

I claim:

1. A rechargeable cooling device, comprising:

a first reservoir configured to contain a liquid;

a second reservoir configured to contain a vapor of the liquid;

a heat exchanger connected to at least one of the first and second reservoirs; and a reusable valve, wherein the first reservoir is in fluid connection with the second reservoir via the reusable valve, wherein the cooling device is configured so that:

(a) when the first reservoir contains the liquid at a first pressure and the second reservoir contains the vapor at a second pressure lower than the first pressure, the heat exchanger is capable of being made to absorb heat at least in part by opening the reusable valve and allowing the liquid to vaporize as the first and second pressures equalize; and (b) when pressures in the first and second reservoirs are approximately equal at a first temperature, and after the heat exchanger has been made to absorb heat, the cooling device is capable of being recharged for a subsequent use at least in part by cooling at least a portion of the cooling device to a second temperature lower than the first temperature, wherein the cooling device further comprises the liquid, wherein the liquid comprises a refrigerant having a vapor pressure at room temperature greater than approximately 1 atm, and wherein the cooling device farther comprises a refrigerator comprising a second heat exchanger, the refrigerator configured to cool and condense the vapor during recharging of the cooling device.

2. The rechargeable cooling device as in claim 1, comprising said liquid in a quantity such that, when said valve is open and pressures in said first and second reservoirs are approximately equal at said first temperature, said liquid is substantially entirely vaporized, wherein said first temperature is in the range of approximately 70° to 100° F.

3. The rechargeable cooling device as in claim 1, further comprising a third reservoir connected to said heat exchanger and configured to hold a substance desired to be cooled, wherein said rechargeable cooling device is an insulated mug, and wherein said third reservoir is shaped to contain no more than about 16 fluid ounces of a beverage.

4. The rechargeable cooling device as in claim 1, further comprising a third reservoir connected to said beat exchanger and configured to hold a substance desired to be cooled, wherein said rechargeable cooling device is an insulated cooler having a storage volume in excess of one cubic foot, and wherein said third reservoir is said storage volume.

5. The rechargeable cooling device as in claim 1, further comprising a third reservoir connected to said heat exchanger and configured to hold a substance desired to be cooled, wherein said rechargeable cooling device is an insulated cooler having a storage volume in excess of one cubic foot, and wherein said third reservoir is a cooling volume of said storage volume having a volume not more than about 48 fluid ounces.

6. The rechargeable cooling device as in claim 1, wherein said valve is adjustable so that a flow rate of vapor passing through said valve may be adjusted.

7. The rechargeable cooling device as in claim 1, further comprising a pressure relief valve connected to at least one of said first and second reservoirs.

8. The rechargeable cooling device as in claim 1, wherein said second reservoir has a volume at least ten times greater than a volume of said first reservoir.

9. The rechargeable cooling device as in claim 1, wherein said second reservoir further comprises an absorbent material chosen to absorb said vapor.

10. A method for cooling a substance, comprising:

providing the rechargeable cooling device as claimed in claim 1;

placing the substance in thermal contact with the heat exchanger;

opening the reusable valve when the first reservoir contains the liquid at a first pressure and the second reservoir contains the vapor at a second pressure lower than the first pressure;

allowing the liquid to vaporize and the heat exchanger to absorb heat from the substance; and recharging the cooling device by:

cooling the vapor to condense the vapor into the liquid;

containing substantially all of the condensed liquid in the first reservoir by, if necessary, transferring the condensed liquid to the first reservoir; and closing the reusable valve.

11. A method as in claim 10, further comprising providing a third reservoir connected to said heat exchanger, and placing said substance in said third reservoir.

12. The rechargeable cooling device as in claim 1, wherein the second reservoir does not comprise an absorbent material to absorb the vapor.

13. A rechargeable cooling device, comprising:

a first reservoir configured to contain a liquid;

a second reservoir configured to contain a vapor of the liquid;

a heat exchanger connected to at least one of the first and second reservoirs; and a reusable valve, wherein the first reservoir is in fluid connection with the second reservoir via the reusable valve, wherein the cooling device is configured so that:

(a) when the first reservoir contains the liquid at a first pressure and the second reservoir contains the vapor at a second pressure lower than the first pressure, the heat exchanger is capable of being made to absorb heat at least in part by opening the reusable valve and allowing the liquid to vaporize as the first and second pressures equalize; and (b) when pressures in the first and second reservoirs are approximately equal and after the heat exchanger has been made to absorb heat, the cooling device is capable of being recharged for a subsequent use, wherein the second reservoir comprises a funnel configured so that while the cooling device is being recharged, liquid condensed from the vapor in the second reservoir falls down the funnel into the first reservoir, and wherein the cooling device further comprises a refrigerator comprising a second heat exchanger, the refrigerator configured to cool and condense the vapor during recharging of the cooling device.

14. The rechargeable cooling device as in claim 13, wherein said valve comprises a valving portion configured to mate with a bottom of said funnel, and wherein said valve may be opened by moving said valving portion downward and closed by moving said valving portion upward.

15. The rechargeable cooling device as in claim 13, wherein said valve comprises a valving portion configured to mate with a bottom of said funnel, and wherein said valve may be opened by moving said valving portion upward and closed by moving said valving portion downward.

16. The rechargeable cooling device as in claim 1, wherein said valve is pressure regulating so as to prevent said first pressure from exceeding a predetermined maximum pressure.

17. A rechargeable cooling device, comprising:

a first reservoir configured to contain a liquid;

a second reservoir configured to contain a vapor of the liquid;

a heat exchanger connected to at least one of the first and second reservoirs; and a reusable valve, wherein the first reservoir is in fluid connection with the second reservoir via the reusable valve, wherein the cooling device is configured so that:

(a) when the first reservoir contains the liquid at a first pressure and the second reservoir contains the vapor at a second pressure lower than the first pressure, the heat exchanger is capable of being made to absorb heat at least in part by opening the reusable valve and allowing the liquid to vaporize as the first and second pressures equalize; and (b) when pressures in the first and second reservoirs are approximately equal at a first temperature, and after the heat exchanger has been made to absorb heat, the cooling device is capable of being recharged for a subsequent use at least in part by cooling at least a portion of the cooling device to a second temperature lower than the first temperature, and wherein the cooling device further comprises a refrigerator comprising a second heat exchanger, the refrigerator configured to cool and condense the vapor during recharging of the cooling device.

18. The rechargeable cooling device as in claim 17, wherein said refrigerator is removably connected to said cooling device.

19. The rechargeable cooling device as in claim 17, wherein the second reservoir further comprises an absorbent material chosen to absorb the vapor.

* * * * *